United States Patent [19]

Fujihara et al.

[11] Patent Number: 4,795,082

[45] Date of Patent: Jan. 3, 1989

[54] CONTAINER WITH SEALABLE BAND

[75] Inventors: Takeo Fujihara, Takatsuki; Akira Yamatani, Minoo; Masanori Yamamoto, Kaizuka; Takako Kubo, Nara, all of Japan

[73] Assignee: House Food Industrial Company Limited, Higashiosaka, Japan

[21] Appl. No.: 904,275

[22] Filed: Sep. 8, 1986

[30] Foreign Application Priority Data

Sep. 10, 1985 [JP] Japan ..... 60-138625[U]
Oct. 4, 1985 [JP] Japan ..... 60-152360[U]

[51] Int. Cl.[4] ..... B65D 5/24

[52] U.S. Cl. ..... 229/109; D9/430; D9/431; D9/452; 229/8; 229/138; 229/922

[58] Field of Search ..... 229/109, 110, 138, 922, 229/923, 8, 45 R, 101, 41 C, 40; D9/331, 414, 430, 431, 452

[56] References Cited

U.S. PATENT DOCUMENTS

| | | | |
|---|---|---|---|
| 256,219 | 8/1980 | Miyazaki | D9/414 |
| D. 270,042 | 8/1983 | Fisher | D9/430 |
| 727,723 | 5/1903 | Webb | 229/8 |
| 2,013,691 | 9/1935 | Martinson | 229/40 |
| 2,160,488 | 5/1939 | Ringler | 229/138 |
| 2,249,881 | 7/1941 | Bouchelle | 229/101 |
| 2,527,705 | 10/1950 | Crary et al. | 229/45 R |
| 4,185,767 | 1/1980 | Sykora et al. | 229/138 |
| 4,248,901 | 5/1981 | Austin | 229/41 C |
| 4,260,101 | 4/1981 | Webinger | 229/101 |

FOREIGN PATENT DOCUMENTS

| | | | |
|---|---|---|---|
| 2636822 | 2/1978 | Fed. Rep. of Germany | 229/110 |
| 861580 | 2/1941 | France | 229/45 R |
| 57-27691 | 6/1982 | Japan . | |
| 671424 | 10/1985 | Japan . | |
| 671425 | 10/1985 | Japan . | |

*Primary Examiner*—Jimmy G. Foster
*Assistant Examiner*—Gary E. Elkins
*Attorney, Agent, or Firm*—Oblon, Fisher, Spivak, McClelland & Maier

[57] ABSTRACT

A container with a sealable band characterized by a container in which the upper and bottom surfaces are of a polyhedral form and a pair of corresponding sides on the upper and bottom surfaces respectively are not parallel with each other; and a sealable band comprising an upper surface portion in which opposite sides form each edge portion, two lateral side portions which are integrally provided extending with the same inclination from each corresponding edge portion of the upper surface portion, and a bottom surface portion extending between the two lateral sides in which the opposite sides form each edge portion.

1 Claim, 5 Drawing Sheets

CONTAINER WITH SEALABLE BAND

FIELD OF THE INVENTION

The present invention relates to a container having a sealable band, and more particularly, an erectable container in which the upper and bottom surfaces are of a substantially equilateral polygonal form having an even number of sides, the container having a stable sealable band passed around it.

BACKGROUND OF THE INVENTION

A container accommodating food therein is sometimes sealed with paste. However, in order to open the container so as to use it as a container or in order to cook food in the opened container, it is desirable that the container be opened without being damaged. Hence the idea of passing a sealable band around the container. However, for a container in which a pair of corresponding sides on the upper and bottom surfaces, respectively, are not parallel with each other, a conventional straight band cannot provide a sufficiently stable sealing.

Particularly, an erectable container tends to expand from its predetermined folded shape due to a restoring force acting on the folded portions. When the container is used, for example, to cook the content therein, it is undesirable to retain the state of being folded by means of an adhesive or the like because there is the danger that the adhesive or the like would dissolve.

Further, an erectable container may be formed with a hole in the center of the upper surface due to a restoring force of the folded portions, but the following problems occur: the contents get polluted or a foreign substance could enter into the container through the hole.

Still further, in case the erectable container is subject to a shinkwrap process after it is filled with the content, it is desirable that a predetermined folded state is retained, even temporarily, at the time of the shrinkwrapping, which is not possible with a conventional container without using an adhesive or a sticky tape.

OBJECT OF THE INVENTION

It is an object of the present invention to provide an erectable container having a sealable band which can stably retain a predetermined folded state without using an adhesive or a sticky tape and can effectively cover the hole or space formed in the center of the upper surface of the container.

It is still another object of the present invention to provide an erectable container in which the cooking directions can be shown on something other than the container itself, thereby eliminating the problem that the container has to be turned upside down to see the cooking directions written on the bottom surface of the container.

SUMMARY OF THE INVENTION

According to the present invention, the above and other objects can be accomplished by a container with a sealing band, composed of a single foldable plate member and a sealing band member. The plate member is provided with a concave fold line forming a bottom portion in the shape of a substantially equilateral polygon in the center of the plate member, radial concave fold lines radially extending from the respective vertexes of the bottom plate portion, intermediate fold lines each consisting of a concave segment and a convex segment connecting intermediate points of adjacent radial concave fold lines, first convex fold lines inclined by an angle $\alpha$ with respect to the radial concave fold lines and connected between the respective vertexes of the bottom plate portion and the junctions of the concave and convex segments of the intermediate fold lines, and second convex fold lines inclined in the same direction as the first fold lines by an angle greater than the angle $\alpha$ with respect to the radial concave fold lines and connected between the respective junctions of the concave and convex segments of the intermediate concave fold lines and the outer edge of the plate member. The sealing band member includes a bottom belt portion formed in the shape of a rectangle whose four vertexes correspond to two pairs of vertexes on opposite sides of the bottom plate portion, two side belt portions formed in the shape of rectangle's, the four vertexes of each side belt portion positionally corresponding to one pair of vertexes on the bottom plate portion and neighboring intermediate points of the radial concave fold lines of the folded plate member, and a top plate belt portion in the shape of a rectangle whose four vertexes positionally correspond to the two pairs of neighboring intermediate points of the radial concave fold lines on opposite sides of the foldable plate member.

The intermediate concave fold lines and the second convex fold lines may be perforated.

DESCRIPTION OF THE PREFERRED EMBODIMENT

Figure 2:
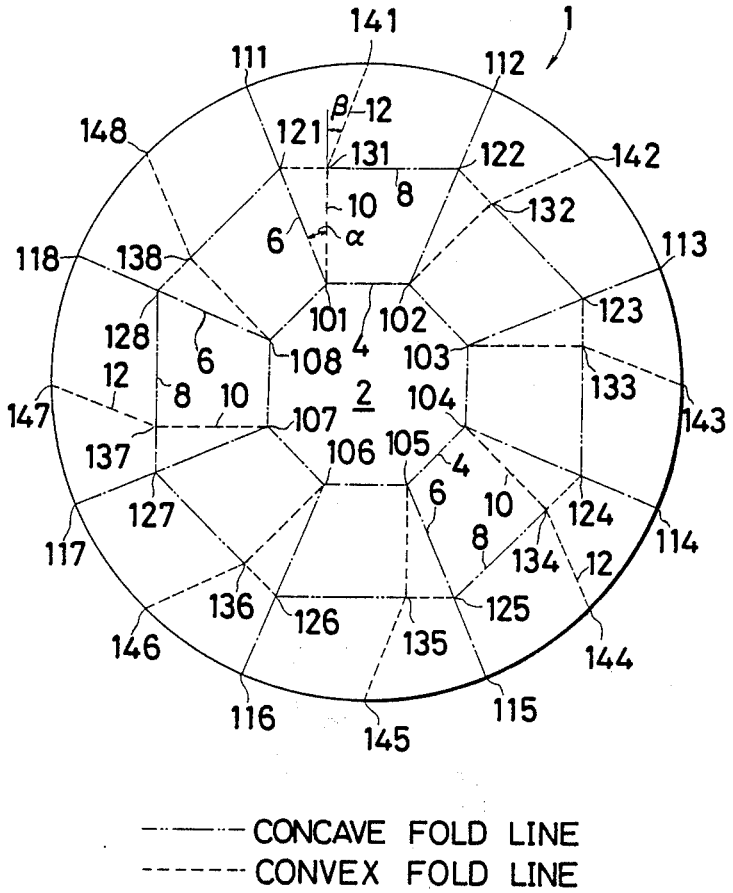
FIG. 2 illustrates processing of the board member comprising the container.

The embodiment of the present invention is hereinafter described with reference to the appended drawings. Firstly, the erectable container will be described. Referring to FIG. 2 which shows the wrong side of the board up, there is provided a board member 1 cut out in a circle. The board member 1 has been processed in a waterproof manner by waxing, polyethylene laminating or the like. A bottom plate portion 2 of an equilateral octagonal form is positioned in the center of the board member 1, and each side 4 of the bottom plate portion 2 is provided with a concave fold line. It should be noted that the terms concave fold line and convex fold line are used as simply meaning to provide a fold line or to perforate a fold line at the time of fold line processing and to mean an actual concave fold or convex fold at the time of assemblying the container.

Radial convex fold lines 6 are provided extending between the vertexes 101 to 108 of the bottom plate portion 2 and points 111 to 118 on the outer periphery of the bottom plate portion 2, respectively. The intermediate fold line 8 connecting the middle points 121 to 128 of the radial fold line 6 is perforated.

The first convex fold pleat lines 10 are provided extending between the vertexes 101 to 108 and intersecting points 131 to 138 on the intermediate line 8, respectively. The lines 10 are respectively inclined in a clockwise direction by an angle $\alpha=22.5°$ with regard to the radial fold lines extending between 101 and 111 to 108 and 118, respectively. Second pleat lines 12, which are constituted by perforated concave fold lines inclined in a clockwise direction by an angle $\beta=22°$ with respect to the first pleat line 10, are provided extending between the intersecting points 131 to 138 and the points 141 to 184 on the outer periphery of the bottom plate portion, respectively.

Figure 3:
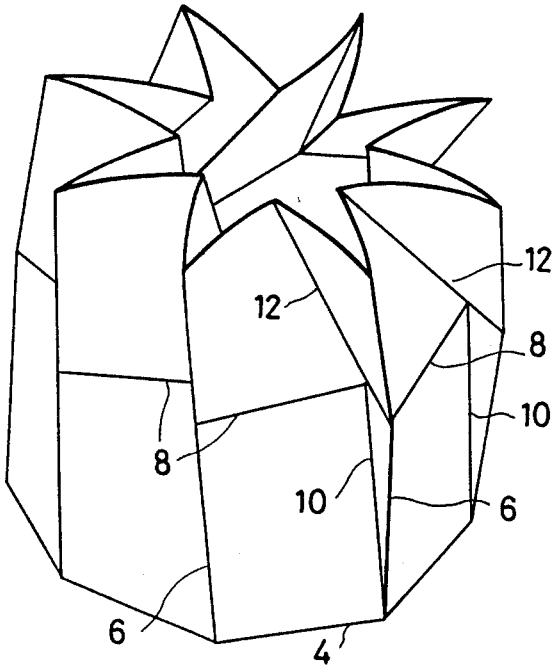
FIG. 3 is a perspective view of the container being folded.

With the arrangement described above, the plate 1 is folded into a container as follows. First, referring to FIG. 3, the sides 4 of the bottom plate portion are concave-folded, the radial fold lines 6 are concave-folded, and the first and second pleat lines 10 and 12, respectively, are convex-folded to get a substantially cylindrical bottom. Then, the area surrounded by the radial fold lines 6 on both sides of the second pleat line 12 and the intermediate fold line 8 is closely folded and then pushed down in a clockwise direction until it becomes substantially horizontal. At this time, the portion of the intermediate fold line 8 surrounded by the radial fold line 6 and the first pleat line 6, both of which extend from the same vertex of the vertexes 101 to 108, makes a convex fold and the remaining portion makes a concave fold. The same folding is repeated for the adjacent pleat line 12, then another, until all the pleat lines 12 are folded to thereby complete a lidded container.

Figure 4:
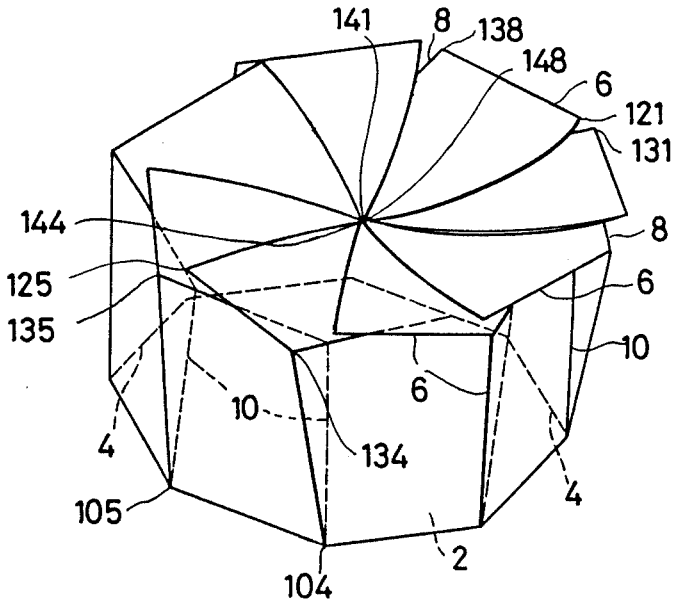
FIG. 4 is a perspective view of the completed container.

Referring now to FIG. 4, the completed container is constituted by the bottom plate portion 2, the pleated cylindrical lateral portion integrally provided on the periphery of the bottom plate portion 2 and surrounded by the sides 4 of the bottom plate portion and the intermediate fold line 8, and the lid portion in which the portion outside the intermediate fold line 8 is folded alternately to the opposite direction at the radial fold lines 6 and the second pleat line 2, overlapped, and then pushed down horizontally so that the ends 141 to 148 of the second pleat line are located substantially in the center of the bottom portion 2.

Figure 5:
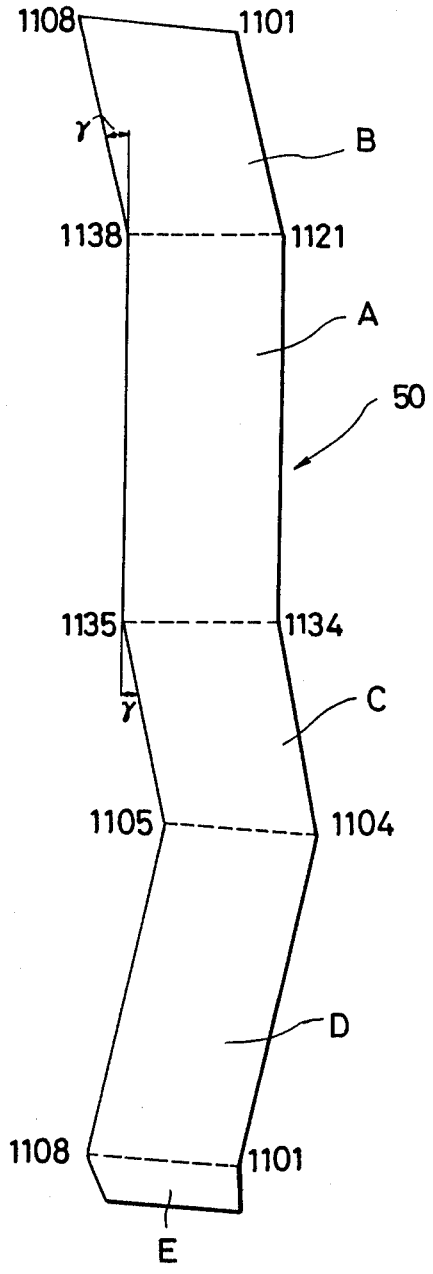
FIG. 5 is a plan view of the sealable band.

Referring now to FIG. 5, the sealable band 50 is constituted by an upper surface portion A 1121-1134-1135-1138 which is virtually identical with the substantially rectangular form 131-134-135-138 on the upper surface, i.e. the lid portion, of the container; lateral sides B and C 1121-1101-1108-1138 and 1134-1104-1105-1135, respectively, which are substantially identical with phantom lateral surface sides 134-104-1-5-135 and 131-101-108-138 respectively and extending respectively at the equal inclination $\gamma$ with respect to said upper surface portion A, and a bottom surface D 1104-1101-1108-1105 which is identical with the rectangle 104-105-108-101 on the bottom surface 2 of the container and extends integrally from said lateral portion.

The inclination $\gamma$ is substantially equal to the angle formed by the straight line 135-138 and the straight line 135-105 when the rectangle 134-135-138-131 and the rectangle 135-134-104-105 are developed in the same plane. A tab E is integrally provided on one side of the bottom surface portion D for joining the bottom surface portion D and the lateral side B.

Figure 1:
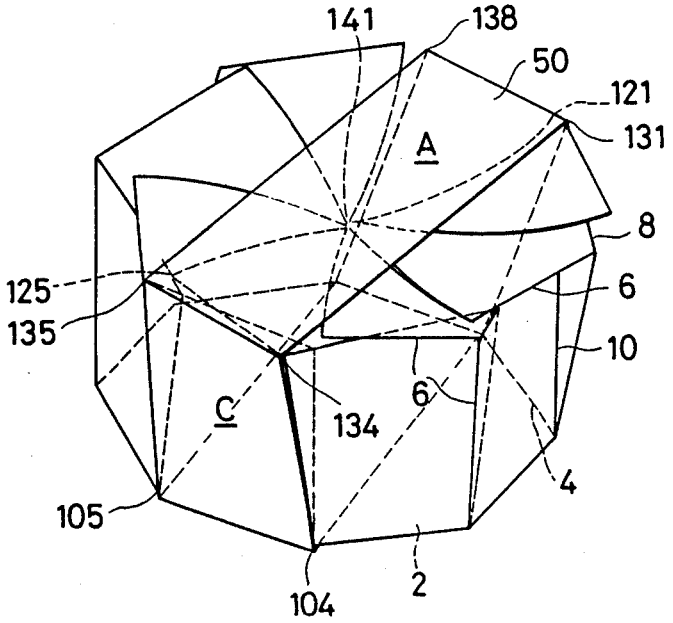
FIG. 1 is a perspective view of the erectable container having a sealable band of the present embodiment in accordance with the present invention.

Referring to FIG. 1, the sealable band 50 is passed around the container 1 with the tab E stuck to the rear surface of the lateral side B. If the content of the container are to be cooked so that the container is used as a cooking vessel and heated by a microwave oven or the like, cooking directions or the like are written on the sealable band 50. Further, the container filled with such contents is subject to shrinkwrapping, if necessary.

In the present invention, the sealable band 50 is formed by a combination of rectangular forms or the like. However, it should be noted that the forms are not strictly limited to the above but forms similar to the above may constitute a sealable band that can sufficiently serve the purpose of taking advantage of the flexibility of the sealable band member.

As described above, the container according to the present invention has a non-lineal band passed around it in which, for example, the line connecting vertexes 1104-10105 is non-parallel to the line connecting vertexes 1134-1135. As such, the present invention is advantageous in that the container in which a pair of corresponding sides on the upper and bottom surfaces respectively are not parallel with each other can stably retain the state of being lidded and therefore it is suitable for being stacked or having a shrinkwrap process, and further that the hole or space in the center of the upper surface can be effectively covered.

Further, since the sealable band can be easily detached from the container and then put back on the container again, it is possible to keep the lid closed after checking or treating the contents. Still further, in case the container is used as a container for cooking by a microwave oven or the like the cooking directions can be written on the sealable band, thereby eliminating the problem that the container should be turned upside down or sideways in order to read the directions.

On the other hand, in the present embodiment, since a plane surface of a band form is formed on a relatively uneven container, it is not only possible to show the product name, trademark, price or the like on a wide area for easy reading, but it is also possible to prevent the shrinkwrap from being damaged by the projections on the container.

The invention has thus been shown and described with reference to a specific embodiment, however it should be noted that the invention is in no way limited to the details of the illustrated embodiment but changes and modifications may be made without departing from the scope of the appended claims.

We claim:

1. A container with a sealing band being composed of a single foldable plate member and a sealing band member, the plate member being provided with:

concave fold lines forming a bottom plate portion in the shape of a substantially equilateral polygon in the center of the plate member, radial concave fold lines radially extending from respective vertexes of the bottom plate portion, intermediate fold lines each consisting of a concave segment and a convex segment connecting intermediate points of adjacent ones of said radial concave lines;

first convex fold lines inclined by an angle $\alpha$ with respect to the radial concave fold lines and connected between the respective vertexes of the bottom plate portion and the junctions of the concave and convex segments of the intermediate fold lines, and second convex fold lines inclined in the same direction as the first convex fold lines by an angle greater than the angle $\alpha$ with respect to the radial fold lines and connected between the respective junctions of the concave and convex segments of the intermediate concave fold lines and the outer edge of the plate member;

the sealing band member including a bottom belt portion formed in the shape of a rectangle having four vertexes which positionally correspond to two pairs of said vertexes on opposite sides of the bottom plate portion, two side belt portions formed in the shape of rectangles, four vertexes of each side belt portion positionally corresponding to one pair of said vertexes on the bottom plate portion and neighboring intermediate points of the radial concave fold lines of the folded foldable plate member, a top belt portion in the shape of a rectangle having four vertexes which positionally correspond to the two pairs of neighboring intermediate points of the radial concave fold lines on opposite sides of the folded foldable plate member, wherein the intermediate concave folded lines and the second convex fold lines are perforated, wherein said side belt portions are inclined by an angle $\gamma$ with respect to said top and bottom belt portions, and wherein said side belt portions are each connected to at least one of said bottom and top belt portions along lines connecting respective pairs of said vertexes, and wherein the lines connecting respective pairs of said vertexes at a joinder of each of said side belt portions with said bottom portion are non-parallel with the lines connecting respective pairs of said vertexes at a joinder of said side belt portions with said top portion.

* * * * *